US005131146A

United States Patent [19]

Leininger

[11] Patent Number: 5,131,146

[45] Date of Patent: Jul. 21, 1992

[54] NAIL CLIPPER RECEPTACLE

[75] Inventor: Kent E. Leininger, Jackson Center, Ohio

[73] Assignee: Material Handling & Automation Concepts, Inc., Jackson Center, Ohio

[21] Appl. No.: 780,890

[22] Filed: Oct. 23, 1991

[51] Int. Cl.[5] ..... A45D 29/00

[52] U.S. Cl. ..... 30/28; 132/75.5

[58] Field of Search ..... 30/28, 26; 132/75.5

[56] References Cited

U.S. PATENT DOCUMENTS

| | | | |
|---|---|---|---|
| 3,943,948 | 3/1976 | Sartore | 132/73 |
| 4,062,109 | 12/1977 | Min | 30/28 |
| 4,219,929 | 9/1980 | Min | 30/28 |
| 4,550,496 | 11/1985 | Reinicke | 30/124 |
| 4,577,754 | 3/1986 | Jones | 30/28 |
| 4,602,430 | 7/1986 | Allen, Jr. | 30/28 |
| 4,640,011 | 2/1987 | Gamble | 30/28 |
| 4,776,090 | 10/1988 | Grassi | 30/28 |
| 4,847,994 | 7/1989 | Dunn | 30/28 |

*Primary Examiner*—Douglas D. Watts

[57] ABSTRACT

A finger/toe nail clipper receptacle is disclosed which receives a finger/toe nail clipper and contains the finger/toe nail clippings ejected by the finger/toe nail clipper. This receptacle has a rear sleeve which receives a rear portion of the finger/toe nail clipper and front shield that receives the front portion of the finger/toe nail clipper for containing the finger/toe nail clippings ejected by the finger/toe nail clipper. The front shield is attached to the rear sleeve by a live hinge which allows the front shield to be pulled away from the front portion of the finger/toe nail clipper pivoting about the live hinge, thereby releasing the finger/toe nail clippings.

8 Claims, 6 Drawing Sheets

NAIL CLIPPER RECEPTACLE

BACKGROUND OF THE INVENTION

This invention relates to finger/toe nail clipper accessories that are used to contain nail clippers, and more specifically to an accessory which is used to contain a finger/toe nail clipper and to receive and contain the finger and toe nail clippings ejected by the finger/toe nail clipper.

The conventional finger/toe nail clipper is used to receive a finger or toe nail portion and clip the portion thereby producing finger or toe nail clippings. When the finger or toe nail is clipped the clippings are ejected out away from the finger/toe nail clipper. Once ejected the clippings are generally dispersed about the area in which the finger or toe nails are being clipped. These clippings tend to be small and difficult to retrieve once ejected from the finger/toe nail clipper.

Attempts have been made in the past to contain these clippings once they are ejected by the finger/toe nail clipper. For example U.S. Pat. No. 4,776,090 issued to Grassi shows a nail clipper catcher for receiving the nail clippings as they are clipped from ones fingers or toe nails. The Grassi structure is unsatisfactory because it requires a special nail clipper to be used with the structure.

Another example is U.S. Pat. No. 4,219,929 issued to Min shows a nail clipper having a shifting receptacle which shifts back and forth in between the upper and lower members of the finger nail clipper. The Min structure is unsatisfactory since it does not conform to all finger and toe nail clippers and also can shift back and forth, thus accidentally releasing the finger or toe nail clippings.

Still another example is U.S. Pat. No. 4,602,430 issued to Allen showing a Nail Clipper Handle and Clipper Catcher which surrounds the entire nail/toe clipper and catches the clippings. The Allen structure is unsatisfactory due to its bulky and large structure.

Numerous finger/toe nail clippers receptacles have been patented but have not been utilized since they where either too bulky, did not function properly or were too expensive to manufacture and sell.

SUMMARY OF THE INVENTION

The objects of the present invention are to provide a finger/toe nail clipper receptacle which can be used on all makes of finger/toe nail clippers.

Another object of the present invention is to provide a finger/toe nail clipper receptacle which is easy to produce and inexpensive to produce.

Still another object of the present invention is to provide a finger/toe nail clipper receptacle which is easy to install on the finger/toe nail clipper and is easily closed and opened thereby receiving or releasing the finger or toe nail clippings respectively.

The objects of the present invention are accomplished by providing a finger/toe nail clipper receptacle having a rear rectangular sleeve having top, bottom, first, and second walls The sleeve has two ends, a closed end and a receiving end for receiving said finger/toe nail clipper. A front rectangular shield having bottom, first and second side walls, with the bottom wall of the front shield pivotally attached to the bottom wall of the rear sleeve. The front shield pivots relative to the rear sleeve in an open and closed position. The front shield defines a receiving area for receiving the nail clippings ejected by the finger/toe nail clipper in the closed position and releasing the nail clippings from the receiving area in the opened position.

Other objects and advantages of the present invention will be apparent from the following description, the accompanying drawings and the appended claims.

DETAILED DESCRIPTION OF THE PREFERRED EMBODIMENT

Figure 1:
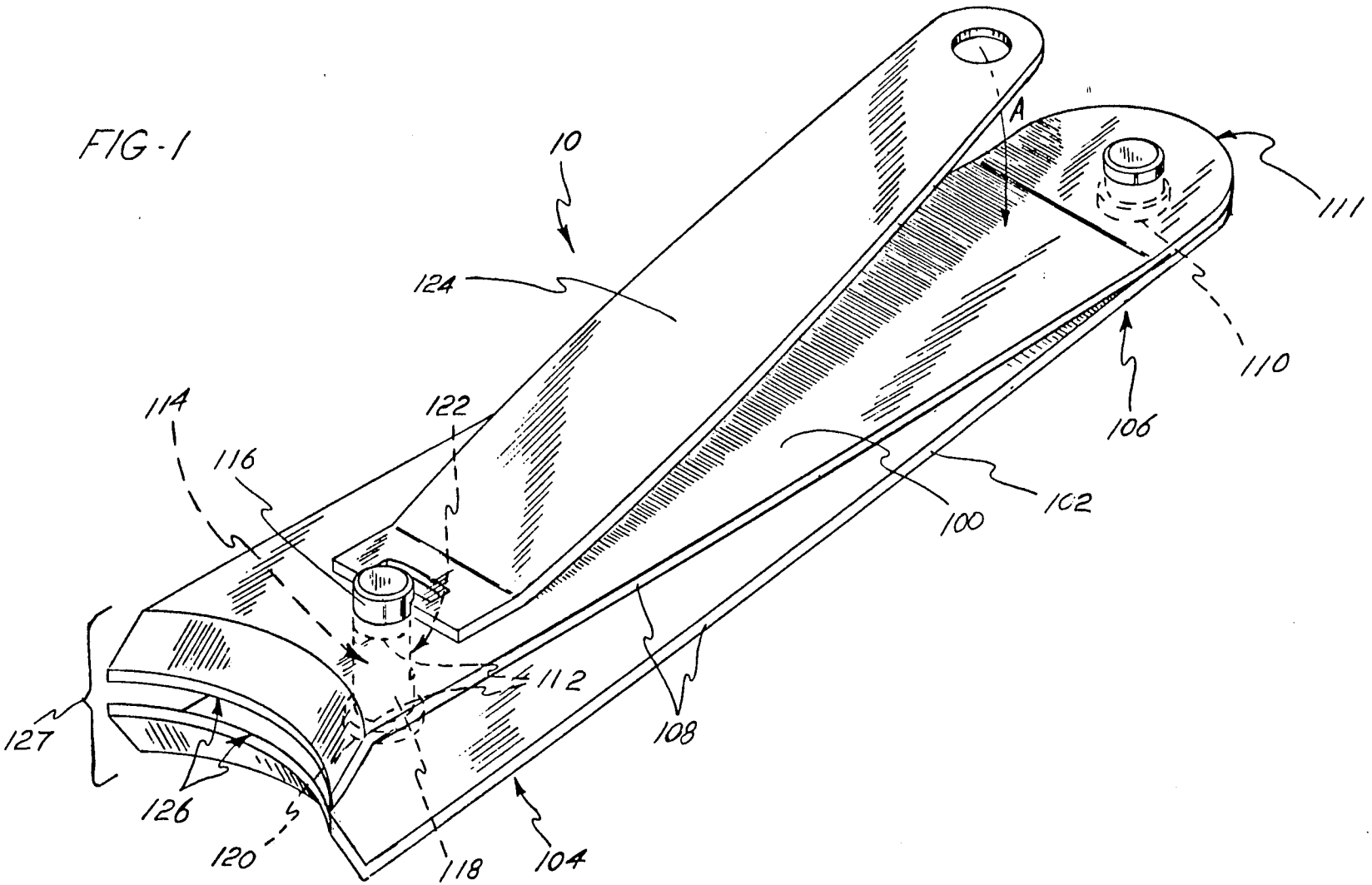
FIG. 1 is a perspective view of a finger/toe nail clipper.

Referring to the drawings, in FIG. 1 there is shown a typical finger/toe nail clipper 10 which is comprised of an upper elongated spring member 100 and a lower elongated spring member 102 each having generally parallel side edges 108. Each elongated member 100 and 102 has a front portion 104 and a rear portion 106. The upper elongated spring member 100 is attached to the lower elongated spring member 102 at their rear portions 106 by a fastener 110, such as a rivet, which is located at a midpoint between the side edges 108 or by welding the upper elongated spring member 100 to the lower elongated spring member 102. The fastening of the rear portion 106 positions the upper 100 and lower 102 elongated member's rear portions 106 parallel each other. The rear portions 106 of the elongated spring members 100 and 102 defines a back edge 111.

The front portion 104 of each of the elongated members 100 and 102 diverge away from each other with respect to the rear portion 106. The front portions 104 of the upper 100 and lower 102 elongated members have generally perpendicular sharp cutting edges 126 for cutting a finger/toe nail portion. These sharp cutting edges 126 form a jaw 127.

An aperture 112 is located in each elongated spring member 100 and 102 midway between each elongated spring member's 100 and 102 side edge 108 and distal the fastener 110 and rear portion 106. These apertures 112 provide for a stud 114 which has a diameter less than the diameter of the apertures 112. The stud 114 has a top portion 116 and a bottom portion 118 and is positioned through the apertures 112 so that the top portion 116 of the stud 114 extends beyond the upper elongated spring member 100. Attached to the bottom portion 118 of the stud 114 is a head 120, with a diameter larger than the diameter of the aperture 112 in the lower elongated spring member 102. The head of the stud 114 engages the circumference of the lower elongated spring member's 102 aperture 112 thereby maintaining the stud 114 in position through the apertures 112.

A notch 122 is located midway between the top 116 and bottom 118 portions of the stud 114. A lever 124 is positioned in the notch 122 and in use is moved in the direction of arrow A, thereby compressing the upper 100 and lower 102 elongated arms together. This compressing causes the sharp cutting edges 16 to engage each other thereby cutting a finger/toe nail portion, thus producing a finger/toe nail clipping.

Figure 2:
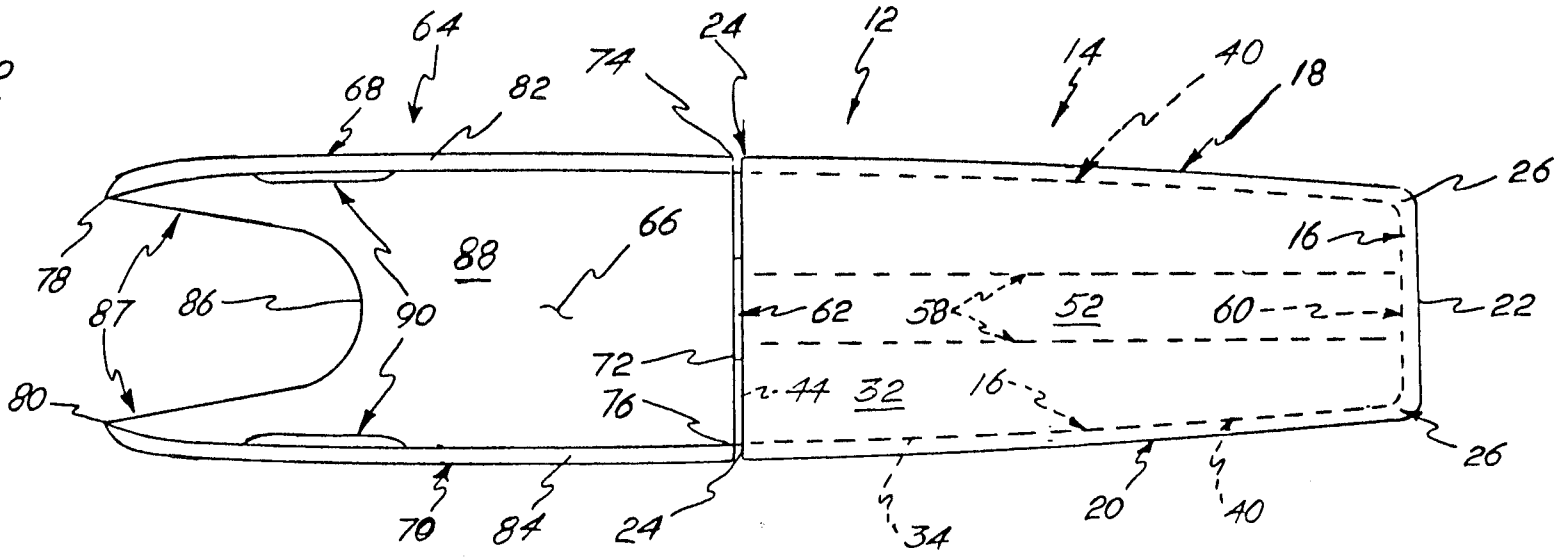
FIG. 2 is a top view of the finger/toe nail clipper receptacle.
Figure 3:
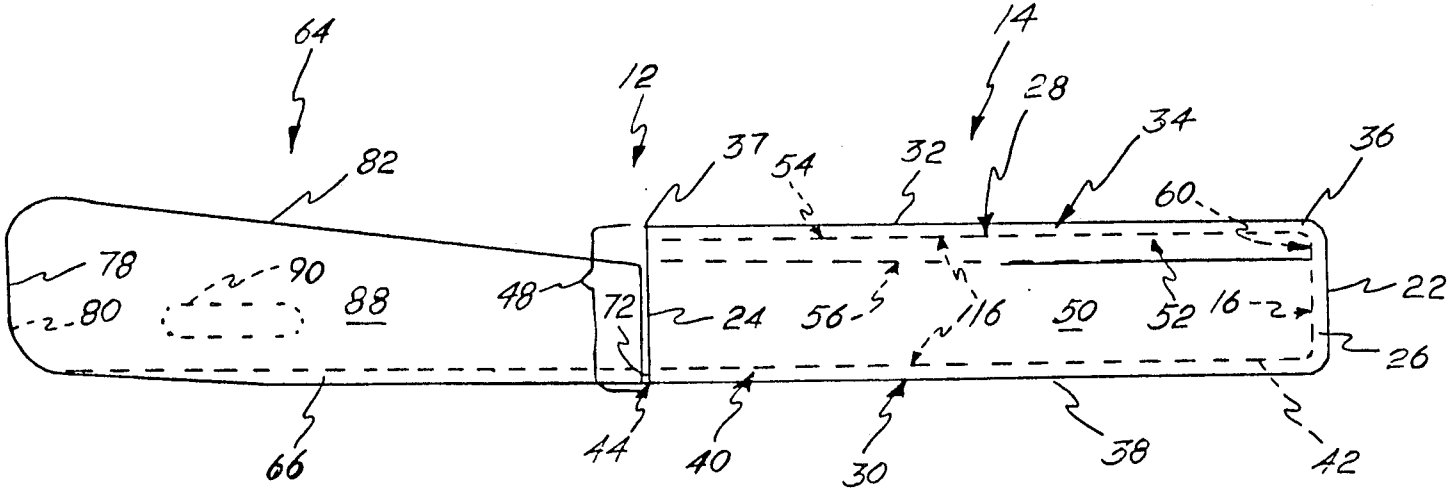
FIG. 3 is a side view of the finger/toe nail clipper receptacle.
Figure 4:
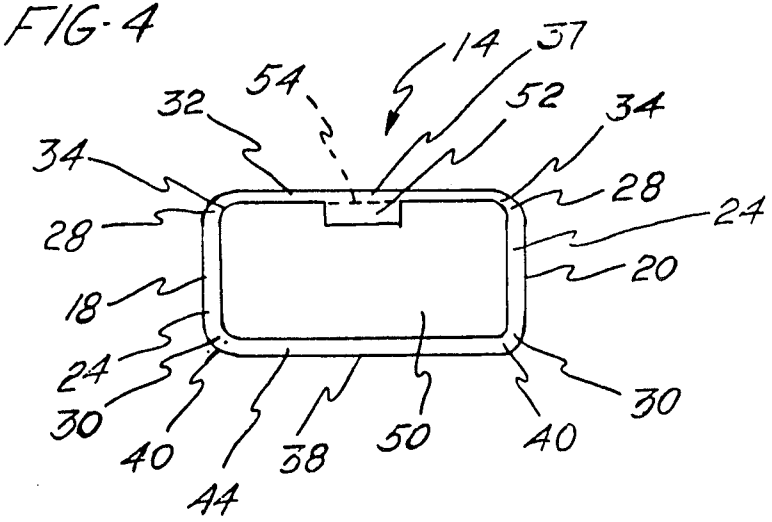
FIG. 4 is a cross-sectional view of the rear sleeve of the finger/toe nail receptacle.

With respect to the receptacle 12, referring to FIGS. 2, 3, and 4, there is shown a top view, FIG. 2, and side view, FIG. 3, and a cross-sectional view, FIG. 4, of the receptacle 12 with the interior walls 16 of the rear sleeve 14 shown in phantom. The rear sleeve 14 has a first 18 and second 20 side walls which are attached to a back wall 22. Each side wall 18 and 22 has a front edge 24, a back edge 26, a top edge 28 and a bottom edge 30. The back edge 26 of each side wall 18 and 20 is attached in a continuous relation to the back wall 22. The top edges 28 of the side walls 18 and 20 are attached in a continuous relation to the side edges 34 of the top wall 32. The top wall's 32 back edge 36 is attached in a continuous relation with the back wall 22. Further the bottom edges 30 of the side wall 18 and 20 are attached in a continuous relation with the side edges 40 of the bottom wall 38. The bottom wall's 38 back edge 42 is attached in a continuous relation to the back wall 22. Preferably, the rear sleeve 14 is molded by plastic injection molding as one complete sleeve 14.

As shown in FIGS. 2 and 4, the side walls 18 and 20 are generally parallel each other and slightly diverge from the back wall 22. This allows the rear sleeve 14 to conform to most finger/toe nail clippers 10. As shown in FIGS. 3, and 4 the top 32 and bottom 38 walls are parallel each other.

The front edges 24 of the side walls 18 and 20 along with the front edges 37 and 44 of the top 32 and bottom 38 walls form a receiving end 48 which receives the finger/toe nail clipper 10. The first 18, second 20, top 32, and bottom 38 walls form an interior 50 in the rear sleeve 14 where the finger/toe nail clipper 10 is positioned.

A key 52, shown in phantom in FIGS. 2 and 3, and shown in FIG. 4, is attached to the top wall 32. The key has a top side 54, a bottom side 56 and side walls 58. The top side 54 of the key 52 is attached to the top wall 32 parallel to the top wall 32. The side walls 58 of key 52 are generally parallel the side walls 18 and 20 of the rear sleeve 14. The back side 60 of the key is attached to the back wall 22 and the front side 62 of the key 52 is even with the front edges 24, 37, 44, of the sides 18 and 20, top 32 and bottom walls thereby being part of the receiving end 48. The width of the key 52 is preferably less than one-half the distance between the side walls 18 and 20 of the rear sleeve 14. The key 52 maintains the finger/toe nail clipper 10 in the interior 50 of the rear sleeve 14.

Figure 5:
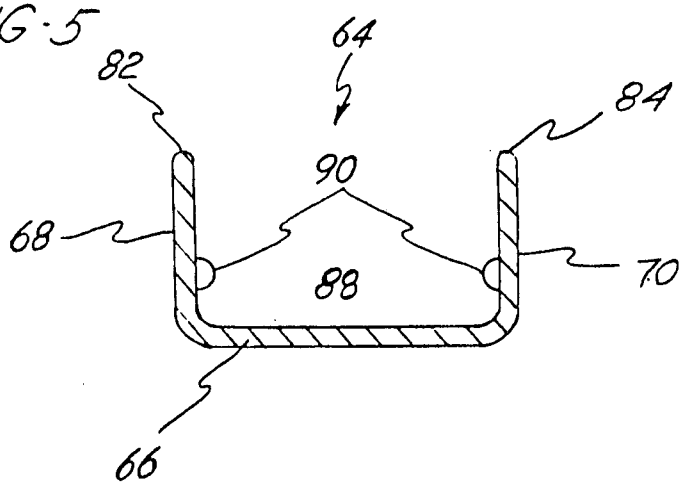
FIG. 5 is a cross-sectional view looking into the front shield of the finger/toe nail receptacle.

Also shown in FIGS. 2, 3, and 5 is the front shield 64 of the present invention. A bottom wall 66 of the front shield 64 has a front edge 86 which defines a notch 87. A notch 87 is provided for the head 120 of the finger/toe nail clipper 10. The front shield's 64 bottom wall's 66 back edge 72 is attached in continuous relation with the rear shield's 14 bottom wall's 38 front edge 44. The first side wall 68 and second side wall 70 each have a front edges 78 and 80 and a back edge 74 and 76, with the back edge 74 and 76 disposed against front edges 24 of side walls 18 and 20. The side walls 68 and 70 of the front shield are attached in a continuous relation with the bottom wall 66 of the front shield 64. A receiving area 88 is defined by the upper 100 and lower 102 elongated members, and side walls 68 and 70. The receiving area 88 of the front shield 64 receives the finger/toe nail clippings ejected. The top edges 82 and 84 of side walls 68 and 70 provide an opening to allow the lever 124 to extend away from the finger/toe nail clipper 10.

In FIGS. 2, 3 and in FIG. 5, there is shown elongated ribs 90 having a semicircular cross-section attached to the interior of the side walls 68 and 70 in the receiving area 88. These elongated ribs 90 maintain the finger/toe nail clipper 10 in position inside finger/toe nail clipper receptacle 12.

Figure 6:
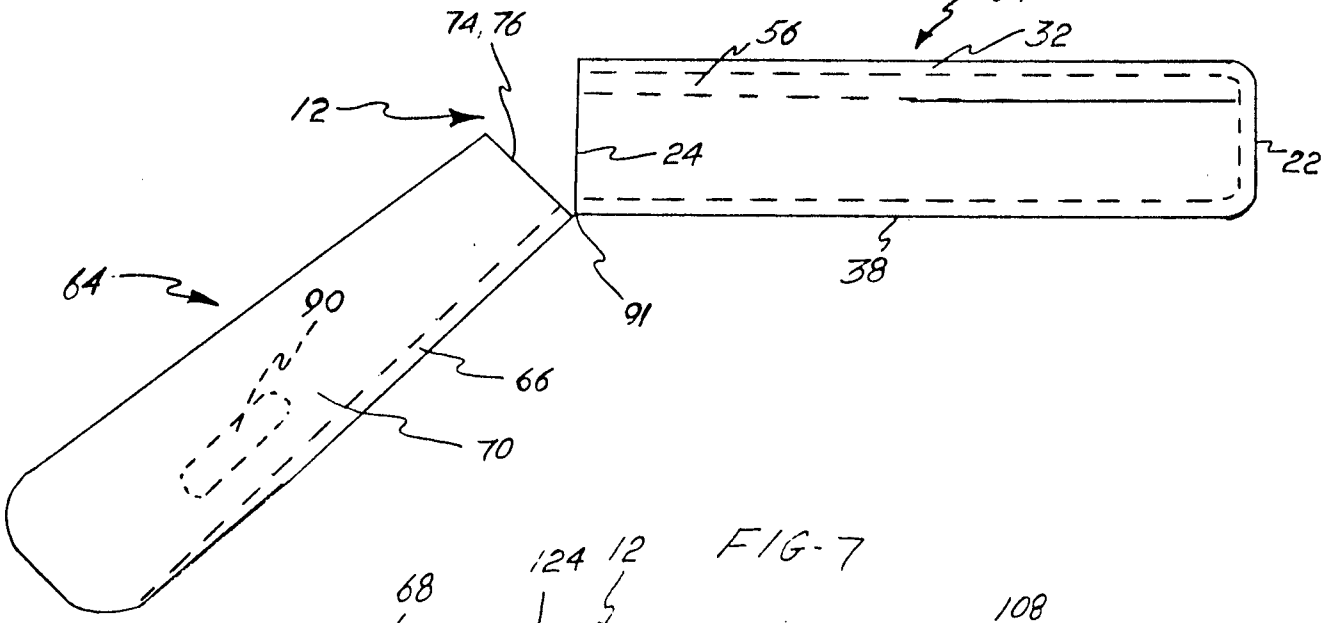
FIG. 6 is a side view of the front shield of the finger/toe nail receptacle in the opened position.

Now referring to FIG. 6, there is shown the front shield 64 in an open position with respect to the rear sleeve 14. The bottom wall 66 of the front shield 64 is pivotally attached to the bottom wall 38 of the rear shield 14. A hinge at point 91 can be attached to both bottom walls 38 and 66 to provide the pivoting means for the front shield 64 to pivot. In the preferred embodiment the front shield 64 pivots about a live hinge which is formed during the molding of the receptacle. Preferably, the front shield 64 and rear sleeve 14 are molded at the same time by a plastic injection molding process. Thus, live hinge 91 is formed during the molding process which is a narrow strip of flexible molded plastic which allows the front shield 64 to pivot to an opened position. When the front shield 64 pivots in a closed position as shown in FIG. 3, the back edges 74 and 76 of the side walls 68 and 70 of the front shield 64 will butt up against the front edges 24 of the side walls 18 and 20 of the rear sleeve 14.

Figure 7:
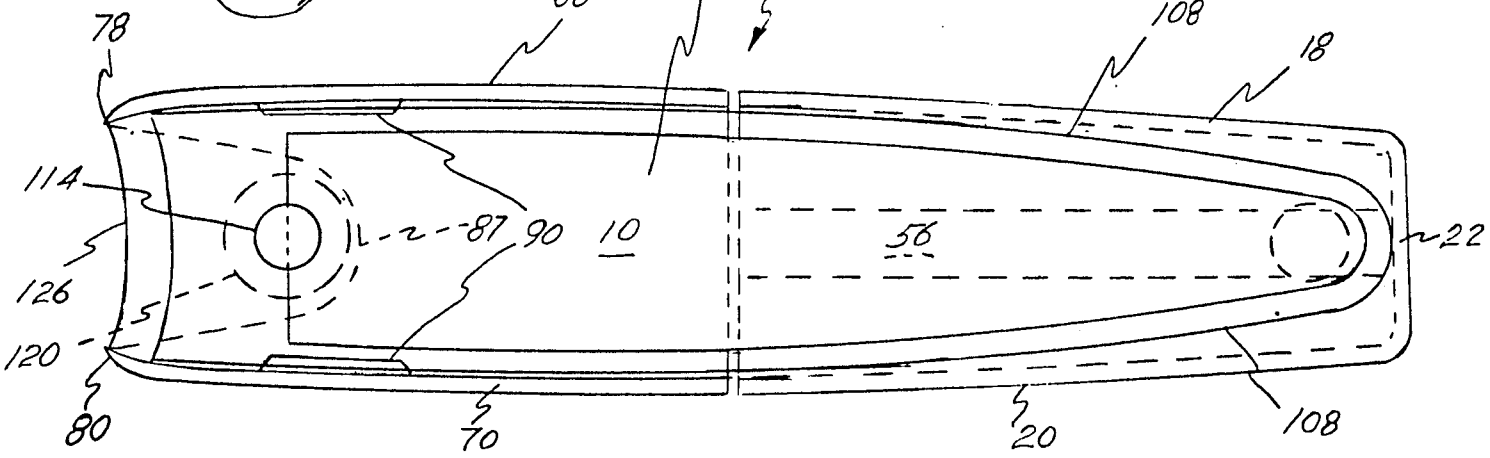
FIG. 7 is a top view of the finger/toe nail clipper in the finger/toe nail clipper receptacle.
Figure 8:
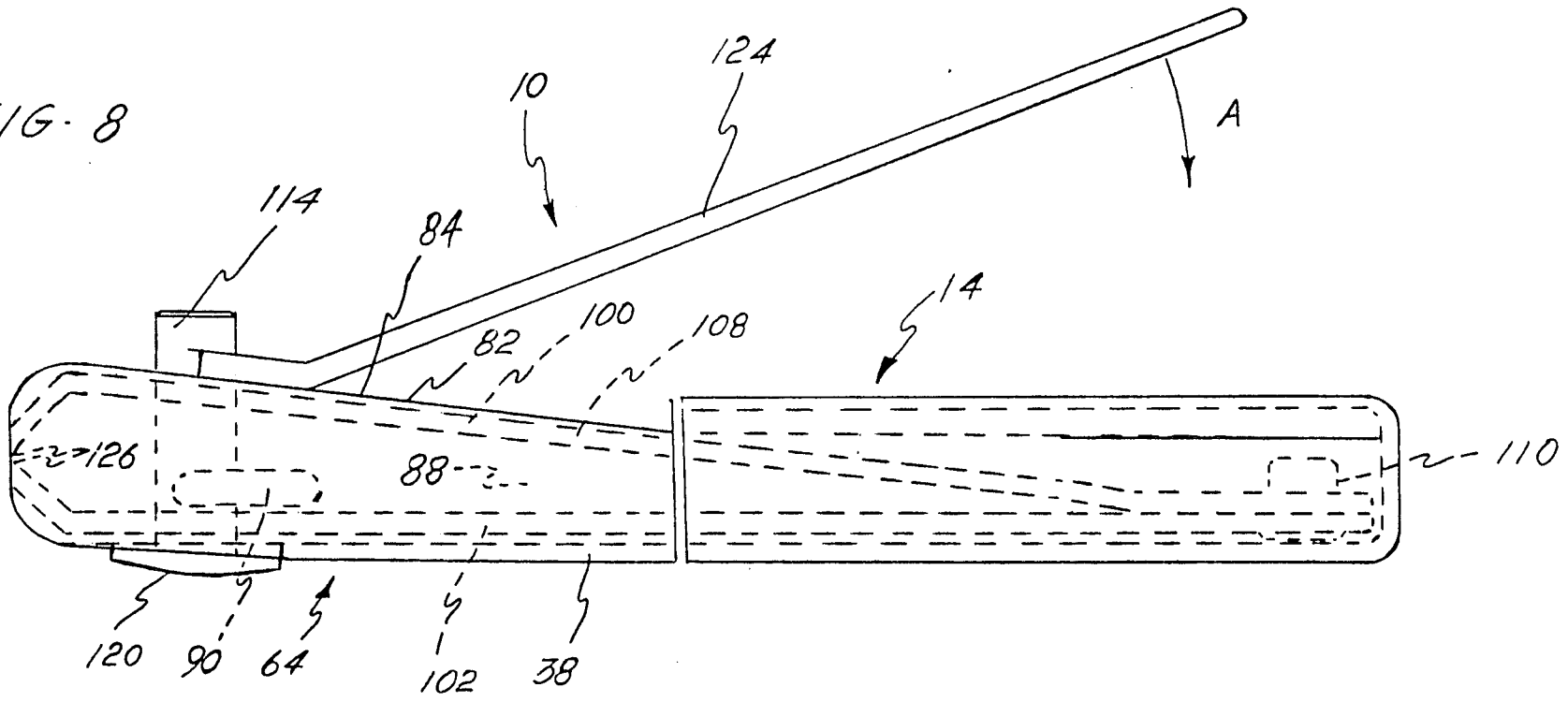
FIG. 8 is a side view of the finger/toe nail clipper with the front shield in the closed position.
Figure 9:
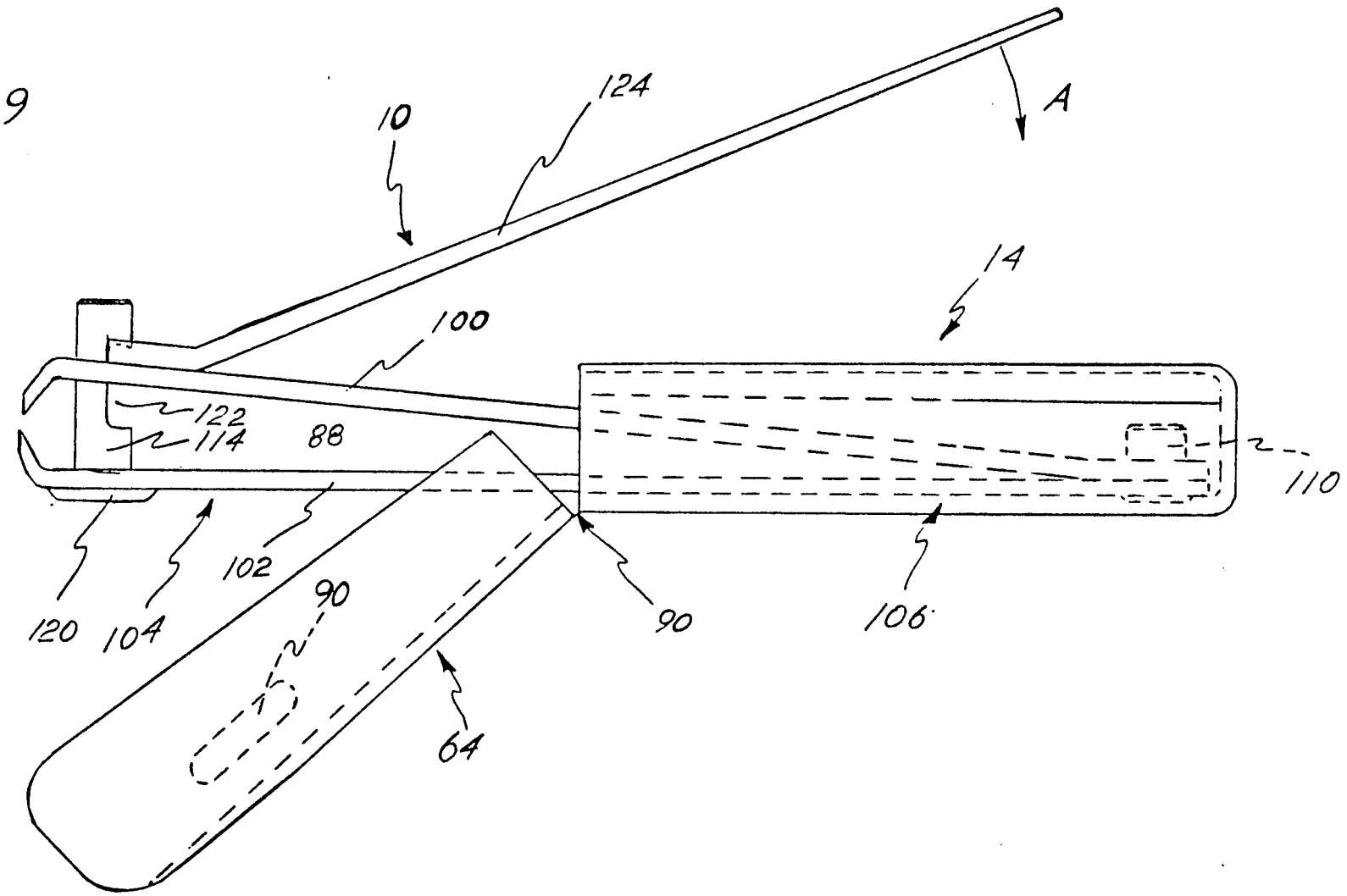
FIG. 9 is a side view of the finger/toe nail clipper in the finger toe nail clipper receptacle with the front shield in the opened position.

In FIGS. 7, 8 and 9 the finger/toe nail clipper 10 is shown inside the receptacle 12. FIG. 7 is a top view of the finger/toe nail clipper 10 and receptacle 12, FIG. 8 is a side view of the finger/toe nail clipper 10 with the receptacle 12 in the closed position, and FIG. 9 is a side view of the finger/toe nail clipper 10 and receptacle 12 in the opened position.

Referring to FIG. 7, the head 120 of the stud 114 of the finger/toe nail clipper 10 engages notch 87. The front edges 78 and 80 of the side walls 68 and 70 of the front shield 64 engages the sharp cutting edges 126 thereby preventing the finger/toe nail clipper from sliding out of the receptacle 12. The back edges 111 of the rear portion of the finger/toe nail clipper 10 engages the back wall 22 of the rear sleeve 14, thereby positioning the jaw 127 adjacent to the front edges 78 and 80 of sidewalls 68 and 70. The side edges 108 of the finger/toe nail clipper 10 engage the side walls 18 and 20 of the rear sleeve 14 thereby preventing the finger/toe nail clipper 10 from sliding side to side.

Referring to FIG. 8, the front shield 64 is maintained in the closed position by ribs 90. As shown, the ribs 90 are located parallel the lower elongated member 102 opposite the bottom wall 38. Thus the lower elongated member 102 is positioned between the ribs 90 and the bottom wall 38 thereby maintaining the front shield 64 in the closed position.

Further, the top edges 82 and 84 of the side walls 68 and 70 engage the edges 108 of the upper elongated member 100. The upper 100 and lower 102 elongated members and the side walls 68 and 70, as stated above, define the receiving area 88 for receiving the finger and toe nail clippings ejected from the sharp cutting edges 126 when the upper 100 and lower 102 elongated members are compressed together by the lever 124.

Referring to FIG. 9, the front shield 64 is in the opened position. The opening of the front shield 64 is performed by pulling the front shield 64 down away from the front portion 104 of the finger/toe nail clipper 10, thereby releasing the finger and toe nail clippings from the receiving area.

While the form of apparatus constitutes a preferred embodiment of this invention, it is to be understood that the invention is not limited to this precise form of apparatus, and that changes may be made without departing from the scope of the invention, which is defined in the appended claims.

What is claimed is:

1. A finger/toe nail clipper receptacle for receiving a finger/toe nail clipper in which the clipper has an upper and lower elongated spring members having generally parallel side edges, and front and rear portions, said rear portions disposed generally parallel to each other and fixed together at said rear portions distal to said front portions and at a midpoint between said parallel side edges, said rear portions of said upper and lower elongated spring members defining a back edge, said front portion of said upper and lower elongated spring members diverge from each other, said front portions of said spring member forming a generally perpendicular and mutually opposed sharp cutting edges such that compression of said upper and lower elongated spring members towards each other engages said sharp cutting edges together thereby cutting finger/toe nail portions, each of said front portions of said upper and lower elongated spring member defining a stud receiving aperture, a stud having a top and bottom positioned through said apertures, and defining a notch located at a midpoint between said stud's top and bottom portions, a head having a diameter larger than said apertures attached to said bottom portion of said stud and engaging said lower elongated spring member, and said top portion of said stud extending through and above said upper elongated spring member, a lever pivotally disposed in said notch of said stud and disposed against said front portion of said upper elongated spring member for compressing said upper and lower elongated spring members together for cutting the finger/toe nail portions with said sharp cutting edges;

the improved finger/toe nail receptacle comprising:

a rear sleeve having a top and bottom walls parallel each other, two side walls generally parallel each other disposed in a continuous relationship with said top and bottom walls, said top, bottom, and side walls defining an interior, a back wall perpendicular to said top, bottom and side walls disposed in a continuous relation with said top, bottom, and side walls, said top, bottom and side walls defining front edges perpendicular to said front, bottom and side walls, said front edges defining a receiving end for receiving said rear portion of said finger/toe nail clipper wherein said rear portion of said finger/toe nail clipper is disposed in said interior of said rear sleeve with said back wall engaging said back edge of said rear portions of said elongated spring members, said side walls of said rear sleeve engaging said parallel side edges of said top and bottom elongated spring members, said bottom wall of said rear sleeve engaging said lower spring member of said finger/toe nail clipper, and said top wall of said rear sleeve engaging said upper spring member; and a front shield for receiving and maintaining finger/toe nail clippings between said upper and lower spring members having a bottom wall with a back edge attached in a continuous relation to said front edge of said bottom wall of said rear sleeve, a pair of side walls having front, back and top edges, said side walls generally parallel each other with said back edge of said side walls disposed in a continuous relation to said front edge of said side walls of said rear sleeve, said side walls attached in a continuous relation with said bottom wall of said front shield, a nail clipping receiving area defined by said side walls of said front shield, said top edges of said side walls of said front shield defining a top opening, said bottom wall having a notch distal said rear sleeve for receiving said head of said stud, said bottom wall and side walls of said front shield defining an interior and receiving said front portion of said finger/toe nail clipper in said interior of said front shield wherein said side walls of said front shield engage said parallel side edges of said elongated spring members, and said notch in said bottom wall of said front shield butting said head of said stud of said finger/toe nail clipper, said front edges of said side walls of said front shield being adjacent to said sharp cutting edges of said finger/toe nail clipper, said top edges of said side walls of said front shield engaging said side edges of said upper elongated spring member, said bottom wall of said front shield engaging said lower elongated spring member, said lever of said finger/toe nail clipper extending out of said top opening of said front shield.

2. A finger/toe nail clipper receptacle as in claim 1 wherein in said top wall of said rear sleeve includes a key having parallel sides generally parallel to said side walls of said rear sleeve and parallel top and bottom walls parallel to said top wall of said rear sleeve, said key having a width less than one-half the distance between said side walls of said rear sleeve, said top wall of said key attached to said top wall of said rear sleeve such that said key extends from the front edge of said top wall to said back wall of said rear sleeve, said key maintains said finger/toe nail clipper in position in said interior of said rear sleeve.

3. A finger/toe nail clipper receptacle as in claim 1 wherein said back edge of said bottom wall of said front shield is attached to said front edge of said bottom wall of said rear sleeve with a hinge thereby allowing said front shield to pivot relative to said rear sleeve to open and close said nail clippings receiving area for removal and retention of the nail clippings.

4. A finger/toe nail clipper receptacle as in claim 3 further comprising a pair of elongated ribs having a semicircular cross section attached to said side walls of said front shield in said receiving area of said front shield, such that in said closed position said elongated ribs are parallel said side edges of said lower elongated spring member opposite said bottom wall of said front shield thereby maintaining said lower elongated spring member between said elongated ribs and said bottom wall of said front shield and maintaining said front shield in said closed position, said back edges of said side walls of said front shield butting against said front edges of said side walls of said rear sleeve in said closed position, said front shield in said opened position releasing from said nail clippings receiving area said finger/toe nail clippings.

5. A finger/toe nail clipper receptacle for receiving a finger/toe nail clipper in which the clipper has an upper and lower elongated spring members defining edges and having two ends being fastened together at one end and diverging away from each at the other end forming a jaw with cutting edges, a stud having two ends with a head at one end and a notch at the other end, said stud positioned through said upper and lower elongated spring members distal the fastened end of said elongated spring members, wherein said head butts against said lower elongated spring member and said notch extends beyond said upper elongated spring member, a lever is positioned in said notch to compress the upper and lower elongated spring members together thereby closing said jaw and cutting a finger/toe nail portion;

the improved receptacle comprising:

a rear sleeve for receiving said finger/toe nail clipper comprising:

a generally rectangular top wall having front, back, first and second side edges;

a generally rectangular bottom wall parallel said top wall of said rear sleeve having front, back, first and second side edges;

a rectangular first side wall having front, back, top and bottom edges with said top edges of said first side wall of said rear sleeve attached to said first side edge of said top wall of said rear sleeve and said bottom edge of said first side wall of said rear sleeve attached to said first side edge of said bottom wall of said rear sleeve, said first side wall of said rear sleeve being perpendicular to said top and bottom walls of said rear sleeve;

a rectangular second side wall having front, back, top and bottom edges with said top edge of said second side wall of said rear sleeve attached to said second side edge of said top wall of said rear sleeve and said bottom edge of said side wall of said rear sleeve attached to said second side edge of said bottom wall of said rear sleeve, and second side wall of said rear sleeve being perpendicular to said top and bottom walls of said rear sleeve;

a rectangular back wall attached to said back edge of said top, bottom, first side and second side walls of said rear sleeve, said back wall of said rear sleeve being perpendicular said top, bottom, first side and second side walls of said rear sleeve;

said top, bottom, first side, second side and back walls of said rear sleeve defining an interior and said front edges of said top, bottom, first side, and second side walls of said rear sleeve defining a receiving end for receiving said fastened end of said finger/toe nail clipper;

a key attached to said top wall of said rear sleeve in said interior having a top, bottom and side walls and a front and rear edges, said top and bottom walls of said key being parallel to each other, said top wall attached to said top wall of said rear sleeve, said rear edge attached to said back wall of said rear sleeve and said front edge being even with said front edge of said top wall of said rear sleeve, said key maintaining said fastened end of said finger/top nail clipper in said interior of said rear sleeve;

a front shield comprising:

a rectangular bottom wall having front, back, first and second side edges, said front edge of said bottom wall of said front shield defining a notch;

a first side wall having top, bottom, front and back edges said bottom edge of said first side wall of said front shield attached to said first side edge of said bottom wall of said front shield, said first side wall of said front shield being perpendicular to said bottom wall of said front shield;

a second side wall having top, bottom, front and back edges said bottom edge of said second side wall of said front shield attached to said second side edge of said bottom wall of said front shield, said second side wall of said front shield being perpendicular to said bottom wall of said front shield;

said first and second side walls of said front shield defining a finger/toe nail clippings receiving area;

a hinge attached to said back edge of said bottom wall of said front shield and attached to said front edge of said bottom wall of said rear sleeve, said front shield pivoting about said hinge relative to said rear sleeve in an open and closed position to open and close said nail receiving area for removal and retention of the nail clippings respectively;

a pair of elongated ribs having a semicircular cross section attached to said first and second side walls of said front shield parallel to said bottom wall of said front shield in said interior of said front shield, such that in said closed position said elongated ribs butt against said side edges of said lower elongated spring member opposite said bottom wall of said front shield thereby maintaining said front shield in said closed position;

said back edges of said first and second side walls of said front shield being adjacent said front edges of said first and second side walls of said rear sleeve in said closed position;

said top edges of said first and second side walls of said front shield being adjacent the edges of said upper elongated spring arm in said closed position;

said notch of said bottom wall of said front shield being adjacent said head of said stud of said finger/toe nail clipper in said closed position; and said front edges of said first and second side walls of said front shield being adjacent said jaw of said finger/toe nail clipper in said closed position.

6. A finger/toe nail clipper receptacle as in claim 5 wherein said first and second side walls of said rear sleeve diverge from said back wall of said rear sleeve.

7. A finger/toe nail clipper receptacle as in claim 5 wherein said first and second side walls of said rear sleeve are generally parallel each other.

8. A finger/toe nail clipper receptacle for receiving a finger/toe nail clipper, the clipper having an upper and lower elongated spring members defining edges and having two ends being fastened together at one end and diverging away from each at the other end forming a jaw with cutting edges, a stud positioned through said upper and lower elongated spring members distal the fastened end of said elongated spring members, a lever is positioned against said stud to compress the upper and lower elongated spring members together thereby closing said jaw and cutting a finger/toe nail portion;

said finger/toe nail clipper receptacle comprising:

a rear rectangular sleeve having top, bottom, first, and second walls, said walls defining an interior, said sleeve having two ends, a closed end and a receiving end for receiving said fastened end of said finger/toe nail clipper in said interior;

a front rectangular shield having bottom, first and second side walls said side walls of said shield attached to said bottom wall, said bottom wall of said front shield pivotally attached to said bottom wall of said rear sleeve, said front shield receiving said diverging end of said finger/toe nail clipper, said front shield pivoting relative to said rear sleeve in an open and closed position; and said front shield defining a receiving area for receiving the nail clippings ejected by the finger/toe nail clipper in said closed position and releasing the nail clippings from said receiving area in said opened position.

* * * * *

UNITED STATES PATENT AND TRADEMARK OFFICE

CERTIFICATE OF CORRECTION

PATENT NO. : 5,131,146

DATED : July 21, 1992

INVENTOR(S) : Kent E. Leininger

It is certified that error appears in the above-identified patent and that said Letters Patent is hereby corrected as shown below:

Claim 5, column 7, line 27, "edges" (second occurrence) should read --edge--.

line 41, "and" should read --said--.

Signed and Sealed this

Seventh Day of September, 1993

Bruce Lehman

*Attest:*

BRUCE LEHMAN

*Attesting Officer*

*Commissioner of Patents and Trademarks*